US005294010A

United States Patent [19]

Tschida

[11] Patent Number: 5,294,010

[45] Date of Patent: Mar. 15, 1994

[54] PRESSURIZING APPARATUS AND CLOSURE FOR CARBONATED BEVERAGE CONTAINERS

[76] Inventor: Mark Tschida, 2697 E. County Road E, Suite 519, White Bear Lake, Minn. 55110

[21] Appl. No.: 980,624

[22] Filed: Nov. 23, 1992

[51] Int. Cl.[5] ..... B65D 39/08; B65D 51/24; B65B 31/00

[52] U.S. Cl. ..... 215/228; 215/356; 215/100 R; 215/260

[58] Field of Search ..... 215/228, 354, 355, 356, 215/320, 321, 100 R, 260, 311; 92/165 PR; 141/64, 65, 27

[56] References Cited

U.S. PATENT DOCUMENTS

| | | | |
|---|---|---|---|
| 3,557,985 | 1/1971 | Poole | 215/37 |
| 4,033,091 | 7/1977 | Saponara | 53/88 |
| 4,179,040 | 12/1979 | Bateman et al. | 220/410 |
| 4,524,877 | 6/1985 | Saxby et al. | 215/228 |
| 4,640,426 | 2/1987 | Wasley | 215/228 |
| 4,723,670 | 2/1988 | Robinson et al. | 215/228 |
| 4,763,802 | 8/1988 | Johnston | 215/228 |
| 4,763,803 | 8/1988 | Schneider | 215/260 |
| 4,768,665 | 9/1988 | Ballas | 215/228 |
| 4,823,968 | 4/1989 | Handzlik | 215/228 |
| 4,838,324 | 6/1989 | Boyd | 141/64 |
| 4,842,151 | 6/1989 | Scott | 215/228 |
| 4,889,250 | 12/1989 | Beyer | 215/228 |
| 4,899,896 | 2/1990 | Metzger | 215/228 |
| 4,911,314 | 3/1990 | Schneider | 215/228 |
| 5,010,928 | 4/1991 | Ballas | 141/64 |
| 5,031,785 | 7/1991 | Lemme | 215/228 |

*Primary Examiner*—Allan N. Shoap
*Assistant Examiner*—Vanessa Caretto

[57] ABSTRACT

A closure with repressurizing apparatus for a carbonated beverage container used as an original factory closure cap or as a replacement to the factory closure. An internally threaded closure which is secured to seal the mouth of a container is combined with a pump cylinder and a hand operated air pump to repressurize the container. The pump cylinder is molded with one or more internal ridges that extend from the base of the pump cylinder to approximately three quarters the length of the pump cylinder. A valve is created when this ridge(s) interacts with the corresponding notch(es) formed on the base of the piston. The valve allows ambient air past the base of the piston only when it is above the ridge(s) on the pump cylinder. The pump cylinder is molded with an internal guide that extends the length of the pump cylinder and is utilized when the base of the piston is above the ridge(s) on the pump cylinder and prevents the piston from rotating out of position with the ridge(s) of the pump cylinder and/or from being removed from the pump cylinder. The pump cylinder is combined with a one way valve that allows ambient air to be pumped into the open space of the beverage container. The top of the closure cap is formed with internal screw threads for engagement with external threads on the bottom of the pump handle. The interaction of these screw threads allows the pump assembly to be secured to the closure cap. A thin rubber gasket is fixed to the underside of the closure to prevent pressure from escaping the beverage container.

3 Claims, 4 Drawing Sheets

PRESSURIZING APPARATUS AND CLOSURE FOR CARBONATED BEVERAGE CONTAINERS

FIELD OF INVENTION

This invention relates to glass and plastic bottle closures, specifically to such closures that are used for repressurizing carbonated beverage containers.

BACKGROUND OF THE INVENTION

Carbonated beverages in glass and plastic containers are pressurized as a result of a carbonation process and sealed by original factory closures. The purpose of the closure is to seal the container and maintain the pressure within the container until it is opened for beverage consumption.

Two and three liter containers have a potential problem of wasting undesirable amounts of beverage when the reusable factory closure releases the pressure within the container. When the pressure loss occurs, tho beverage carbonation is released into the sealed open space of the container. This results in the concentration of beverage carbonation decreasing each time the process is repeated. Accordingly, the quality of the beverage in two and three liter containers gradually deteriorates and such beverage is eventually discarded.

The process of sealing the open space of the beverage container to reduce the loss of carbonation within the beverage is commonly accepted. When the open space within the beverage container is repressurized with ambient air, to a level equal to or greater than the pressure of the gases in the carbonated beverage in the container, the amount of carbonation released from the beverage over time is substantially reduced.

DESCRIPTION OF PRIOR ART

Prior art closure devices have been recognized and demonstrated to repressurize the open space of a carbonated beverage container and maintain the carbonation within a beverage. Such prior art has been developed as repressurizing apparatus that is (a) combined with a closure cap and insertable into the mouth of a container, (b) combined with a closure cap and utilized externally to a container, or (c) detachably combined with a closure cap and utilized externally to a container.

The design of such repressurizing apparatus, as described in a, b, and c above, have proven too cumbersome to be utilized as an original factory closure. In addition, the functional design of all existing prior art comprises a significant number of parts that make the closure device too costly to manufacture when utilized as an original factory closure.

These points are substantiated by the fact that no carbonated beverage manufacturer is utilizing a closure device with repressurizing apparatus as an original factory closure for a carbonated beverage container.

OBJECTS AND ADVANTAGES

Therefore, the primary objective of the present closure device is to provide an improved pressurizing closure combination to be utilized as an original factory closure for a carbonated beverage container. The present closure device can also be utilized as a replacement to the original closure. The primary objective is achieved by providing a factor that no prior art has demonstrated.

This factor is an improved repressurizing device that substantially reduces the number of parts that is utilized by existing prior art. The present closure device comprises a closure cap combined with a pump cylinder, a piston, and a one-way valve in the bottom of the pump cylinder. One or more ridges molded in the pump cylinder interact with corresponding notches formed in the bottom disk of the piston. The interaction of these components make a valve that allows ambient air from the surrounding environment into the pump cylinder. The piston pumps the ambient air through the one-way valve and into the beverage container. The composition of this valve comprises no additional parts.

Only three parts are necessary for repressurizing a carbonated beverage container: the pump cylinder molded as part of the closure cap; the piston; and the one-way valve. This is a significant reduction in the number of parts demonstrated in all prior art. The advantage of this design is based on three parts molded quickly and inexpensively out of plastic or rubber. The cost savings and increased manufacturing efficiency allows the present closure device to be used as an original factory closure.

Another objective of the present closure device is to provide an improved pressurizing closure combination that includes a pump handle molded with internal screw threads for engagement with complimentary threads molded on the top of the closure cap. These threads allow the pump assembly to be securely fastened to the closure cap. This significantly improves the reliability of the original factory closure cap during commercial transportation and handling. The interaction of these screw threads may only occur as a result of the free rotation of the pump handle. The free rotation is permitted by two barbed prongs that are molded to the base of the pump handle. These prongs insert into the top of the piston shaft and secure the pump handle to the piston while allowing free rotation.

Another advantage of the present closure device is to provide an improved pressurizing closure combination that can be utilized with a safety seal ring.

Further objects and advantages will be made apparent from a consideration of the drawings and ensuing description.

DETAILED DESCRIPTION OF PREFERRED EMBODIMENT

Figure 1:
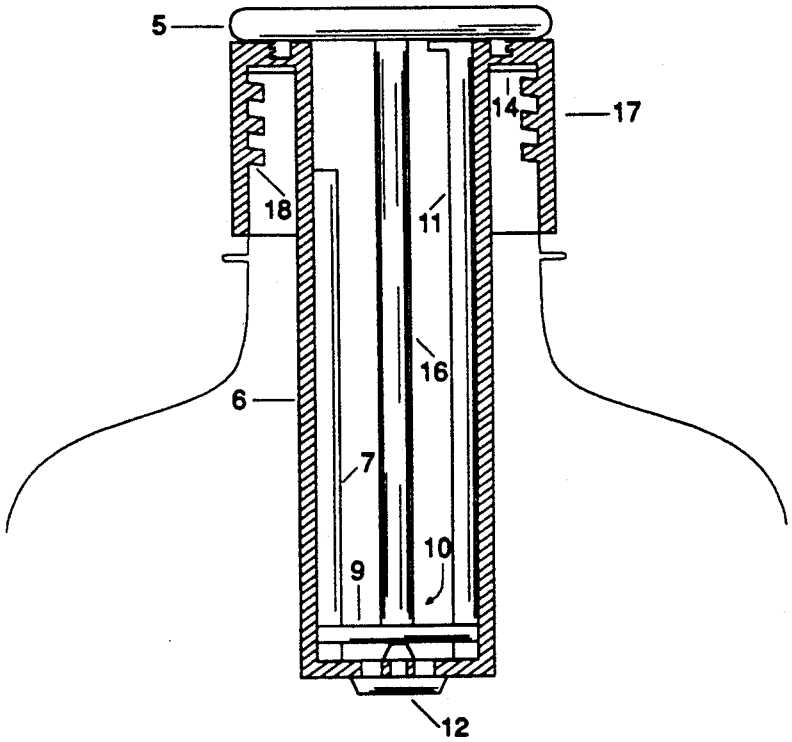
FIG. 1 is a view which shows the relationship of the closure cap and repressurizing apparatus components during a down-stroke operation.
Figure 2:
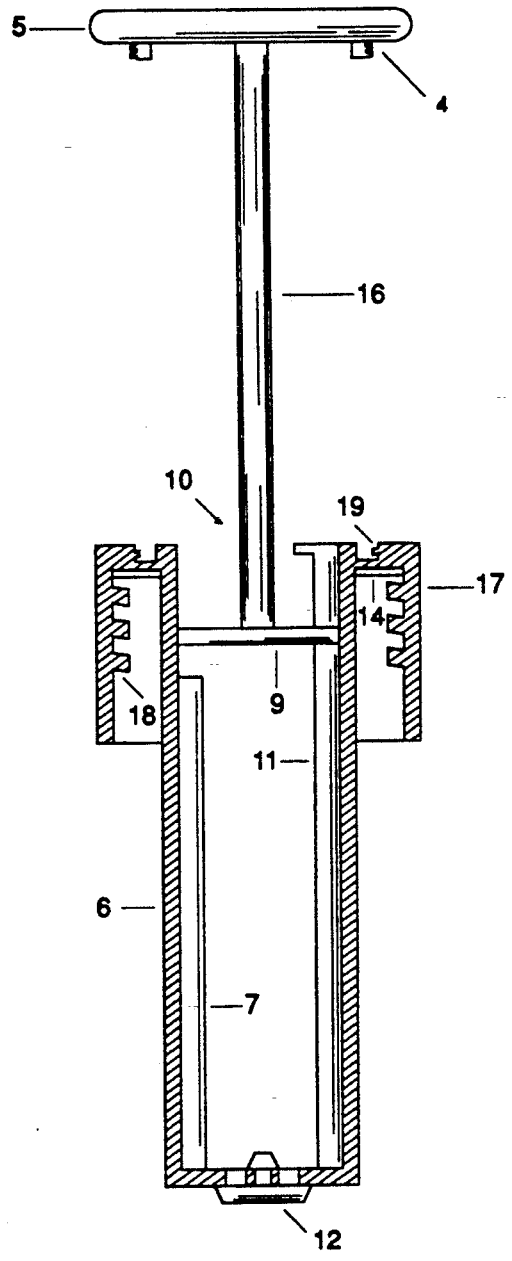
FIG. 2 is a section view of the closure cap and repressurizing apparatus which illustrates the relationship of the assembly components during an up-stroke operation.
Figure 3:
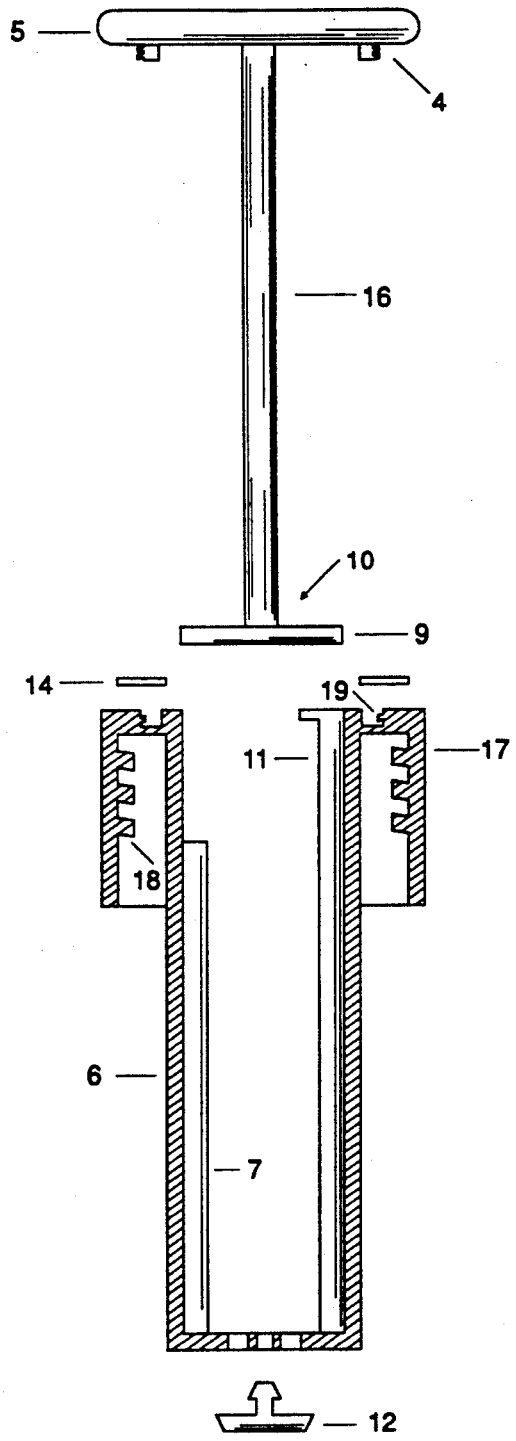
FIG. 3 is an exploded view, partly in section, of the closure cap and pressurizing apparatus of the present closure device.
Figure 4:
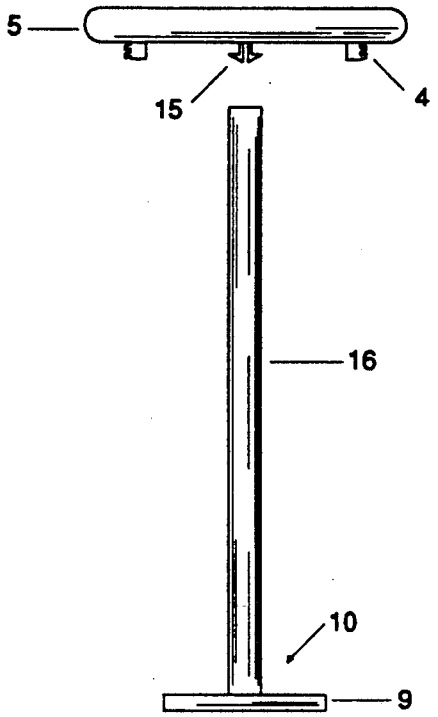
FIG. 4 is and exploded view, partly in section, of the hand operated pump assembly.
Figure 5:
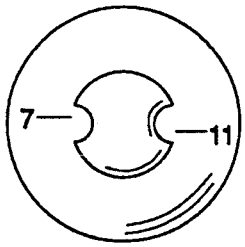
FIG. 5 is a top view of the pump cylinder.
Figure 6:
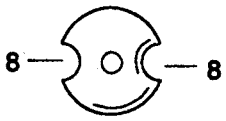
FIG. 6 is a sectional top view of the piston base and shaft.

An improved closure cap and pressurizing apparatus assembly provided for sealing and pressurizing a carbonated beverage container (not illustrated). The assembly is insertable into the mouth of the container and comprises a closure cap 17 with internal screw threads 18 for engagement with complementary threads (not illustrated) on the external sidewall of the container neck. Closure cap 17 is combined with a pump cylinder 6 and a hand operated air pump to repressurize the container. Pump cylinder 6 is molded with one or more internal ridges 7 that extend from the base of pump cylinder 6 to approximately three quarters the length of pump cylinder 6. The radius of internal ridge(s) 7 is not crucial to the design. A valve is created when ridge(s) 7 interact with corresponding notch(es) 8 formed on a base 9 of a piston 10 that constitutes hand operated air pump. The valve allows ambient air past base 9 of piston 10 when base 9 is above ridge(s) 7 on pump cylinder 6. Pump cylinder 6 is molded with an internal guide 1 1 that extends the length of pump cylinder 6 and is utilized when base 9 of piston 10 is above ridge(s) 7 on pump cylinder 6 and prevents piston 10 from rotating out of position in respect to the ridge(s) 7 of pump cylinder 6. The internal guide 11 also prevents piston 10 from being removed from pump cylinder 6.

The top of closure cap 17 is formed with internal screw threads 19 for engagement with complementary external threads 4 molded on the bottom of pump handle 5. Pump cylinder 6 is combined with a one way valve 12 which allows ambient air to be pumped through pump cylinder 6 into the open space of the carbonated beverage container. A thin rubber gasket 14 is fixed to the underside of closure cap 17 which engages the mouth of the beverage container to prevent internal pressure from escaping.

Pump assembly comprises pump handle 5 and piston 10 that is insertable into the open end of pump cylinder 6. The base of pump handle 5 has two barbed prongs 15 for insertion into the top of a piston shaft 16. Prongs 15 allow pump handle 5 to be connected to piston shaft 16 in such a way that pump handle 5 is free to rotate.

Pump assembly can also be molded as a single unit which does not rotate. External threads 4 on pump handle 5 can be replaced by a ring (not illustrated) that engages a depression (not illustrated) which replaces internal threads 19 on the top of closure cap 17. The depression gently holds pump handle 5 in place.

While the above description contains many specificities, these should not be considered as limitations on the scope of the closure device, but rather as an exemplification of one preferred embodiment thereof. Many other variations are possible. Accordingly, the scope of the closure device should be determined not by the embodiments illustrated, but by the appended claims and their legal equivalents.

What is claimed:

1. A closure with repressurizing apparatus for a carbonated beverage container comprising:

(a) an internally threaded, reusable closure cap secured to seal a mouth of the carbonated beverage container, (b) a top surface of the closure cap comprising an embedded internal screw thread, (c) a pump cylinder molded with said closure cap comprising an opening at the top surface and a one-way valve coupled with the pump cylinder, (d) at least one internal vertical ridge molded with said pump cylinder extending approximately three quarters the length of said pump cylinder, (e) a hand operated air pump comprising a piston formed with at least one notch that interacts with the at least one vertical ridge of said pump cylinder to form a valve that regulates the movement of ambient air through said pump cylinder, (f) an internal guide that extends the length of said pump cylinder and is utilized when the piston is above the at least one ridge on said pump cylinder which prevents said piston from rotating and from being removed from said pump cylinder, (g) a pump handle connected to said piston where the pump handle is molded with an external screw thread for engagement with the complementary embedded internal threads on said closure cap, (h) said pump handle comprising two barbed prongs for insertion into said piston allowing said pump handle to rotate freely while said piston does not rotate.

2. A closure with repressurizing apparatus, as defined in claim 1, wherein the utility of said closure and repressurizing apparatus is functional as an original factory closure and as a replacement to the original factory closure.

3. A closure with repressurizing apparatus, as defined in claim 1 or claim 2, wherein said piston and said pump handle can be molded as a single unit which does not rotate.

* * * * *